US005084942A

United States Patent [19]

Schelb et al.

[11] Patent Number: 5,084,942

[45] Date of Patent: Feb. 4, 1992

[54] DEVICE AND METHOD FOR THE FINE CLEANING OF TEXTILE FIBERS HAVING POSITIONABLE BLADES AND GUIDES

[75] Inventors: Heinz Schelb, Wallisellen; Beat Bühler; Ulf Schneider, both of Winterthur, all of Switzerland

[73] Assignee: Rieter Machine Works, Ltd., Winterthur, Switzerland

[21] Appl. No.: 585,707

[22] Filed: Sep. 20, 1990

[30] Foreign Application Priority Data

Sep. 20, 1989 [CH] Switzerland ..... 03419/89

[51] Int. Cl.[5] ..... D01B 3/00

[52] U.S. Cl. ..... 19/200; 19/95; 19/105

[58] Field of Search ..... 19/39, 65 R, 65 A, 80 R, 19/81, 95, 107, 113, 200, 202-205, 306

[56] References Cited

U.S. PATENT DOCUMENTS

| | | | |
|---|---|---|---|
| 244,393 | 7/1881 | Keene | 19/95 |
| 244,394 | 7/1881 | Keene | 19/95 |
| 307,118 | 10/1884 | Keene | 19/95 |
| 641,060 | 1/1900 | Wilde | 19/95 |
| 897,320 | 9/1908 | Onge | 19/95 |
| 1,170,389 | 2/1916 | Armstrong | 19/95 |
| 1,530,286 | 3/1925 | Armstrong | 19/95 |
| 1,751,133 | 3/1930 | Curley | 19/95 |
| 2,900,671 | 8/1959 | Szaloki | 19/95 X |
| 3,559,804 | 2/1971 | Lytton | 19/95 X |
| 4,505,005 | 3/1985 | Staehli | 19/200 |
| 4,547,935 | 10/1985 | Jagst | 19/93 |
| 4,805,268 | 2/1989 | Leifeld | 19/105 |

FOREIGN PATENT DOCUMENTS

| | | | |
|---|---|---|---|
| 3333618 | 4/1985 | Fed. Rep. of Germany . | |
| 0464021 | 10/1968 | Switzerland . | |
| 0215767 | 4/1968 | U.S.S.R. | 19/95 |
| 0265130 | 8/1927 | United Kingdom | 19/95 |
| 0762345 | 11/1956 | United Kingdom . | |

*Primary Examiner*—Werner H. Schroeder
*Assistant Examiner*—Ismael Izaguirre
*Attorney, Agent, or Firm*—Sandler, Greenblum & Bernstein

[57] ABSTRACT

An apparatus and method for use in a cleaning process of textile fibers, and for use in conjunction with an opening roller. The apparatus includes a plurality of separating blades and guide elements which are spaced from the opening roller during the cleaning process. An assembly is provided for adjustably positioning a plurality of the separating blades and the guide elements during the cleaning process. The adjustment of the spacing of the separating blades and the guide elements from the opening roller can be accomplished remotely, either manually or by a motorized drive. A lever unit enables appropriate connection for effecting the various adjustments of the separating blades and the guide elements. The guide elements and the separating blades can be controlled and adjusted to suit the fibers to be processed.

32 Claims, 8 Drawing Sheets

DEVICE AND METHOD FOR THE FINE CLEANING OF TEXTILE FIBERS HAVING POSITIONABLE BLADES AND GUIDES

BACKGROUND OF THE INVENTION

1. Field of the Invention

The invention is directed to the field of spinning machines. More particularly, the present invention relates to the fine cleaning of textile fibers and to a method and a device for performing the method.

2. Description of the Related Art

Textile fibers, particularly cotton fibers, are subjected to coarse cleaning after the fiber bales have been opened, during which the coarse contaminants are removed. The fibers are then subjected to a fine cleaning. With the fine cleaning, all the particles of dirt remaining in the fibers after the coarse cleaning should be removed as much as possible. After the fine cleaning, the fibers are then transported to the next preparation step of the spinning process, for example, to a carding machine.

In the fine cleaning machine, the fibers, in the form of a fiber bat, are conveyed over a toothed, central opening roller through various cleaning steps. During the rotation of the opening roller, the bat is continuously subjected to centrifugal force and, thereby, the contamination particles are concentrated in the outer layers of the bat. In one of the cleaning steps, the centrifuged bat is guided under separating blades in such a way that the uppermost layer with the concentration of particles is separated from the remainder of the bat.

Typically, a guide element is provided which projects into the bat in front of a separating blade, that is, against the transport direction of the fibers. On this guide element the bat is deflected inwardly, i.e., against the centrifugal force, whereby the concentration of the contamination particles is increased. The succession of separating blades and guide elements are repeated at least twice within the same cleaning step.

So that a cleaning step of this type, with separating blades and guide elements, can operate optimally for every fiber origin and for every blend of fiber origin, it must be appropriately adjustable so that all the contamination particles and, as much as possible, only the contamination particles are separated from the fibers.

The fine cleaning machines at the present stage of technology are manually adjustable in such a way, that through adjusting screws or other means, the position of the separating blades and guide elements are adjustable and such that guide elements of different sizes can be fitted. Since every adjustment and setting requires manual intervention with the machine, such adjustments and settings tend to be inconvenient and costly. Further, it is only possible to reset the positions of the separating blades and guide elements for different fiber origins or blends of origins during a machine stoppage.

SUMMARY OF THE INVENTION

It is an object of the invention to provide a device for the fine cleaning of textile fibers with which the fiber bat, rotating on an opening roller, is guided past separating blades and guide elements for the purpose of cleaning of the fiber bat. The device is to be remotely controlled and finely optimized and set for a fiber origin or a blend of fiber origins without manual intervention. Further, the device is to be capable of adjusting the settings of the separating blades and guide elements during the cleaning process cycle. The number of parameters with can be set, and the range of adjustment, are to be of such a type that the optimal fine cleaning can be carried out for a broad spectrum of fiber origins. The settings for all the pairs of separating blades and guide elements comprising the same cleaning steps are to be possible with the same setting mechanism.

It is a particular object of the invention to provide a device for use in a cleaning process of textile fibers, adapted for use in conjunction with an opening roller, the device including:

- a plurality of separating blades adapted to be spaced from the opening roller during the cleaning process;
- a plurality of guide elements adapted to be spaced from the opening roller during the cleaning process; and
- means for adjustably positioning a plurality of the separating blades and the guide elements during the cleaning process.

It is an additional object of the invention to provide a device for use in a cleaning process of textile fibers, adapted for use in conjunction with an opening roller, the device including:

- a plurality of separating blades adapted to be spaced from the opening roller during the cleaning process;
- a plurality of guide elements adapted to be spaced from the opening roller during the cleaning process; and
- means for remote positioning a plurality of the plurality of separating blades and the plurality of guide elements.

According to a specific aspect of the invention, the separating blades and the guide elements are adapted to be located in respective positions in relation to the opening roller, the positioning means includes (i) means for adjusting together respective positions of each of the plurality of the separating blades and (ii) means for adjusting together respective positions of each of the plurality of the guide elements.

According to another aspect of the invention, the positioning means includes means for adjusting respective positions of the separating blades and means for adjusting respective positions of the guide elements, the device further including means for connecting (i) the means for adjusting respective positions of the separating blades and (ii) the means for adjusting respective positions of the guide elements.

More specifically, the connecting means includes a common support frame upon which the plurality of separating blades and the plurality of guide elements are mounted, for selectively adjustably positioning all of the separating blades and the guide elements.

Still further according to the invention, the connecting means includes means for positioning a plurality of the separating blades and the guide elements to a motorized control assembly for selectively remotely adjusting respective positions of the separating blades and the guide elements.

Further, the connecting means includes a lever unit, including a plurality of levers, each of which is operatively connected to one or more of the separating blades and one or more of the guide elements for performing a respective adjustment parameter.

Specifically, according to the invention, the positioning means includes means for selectively setting three respective parameters of adjustment: (i) a distance between the separating blades and the opening roller; (ii) a distance between the guide elements and the opening roller; and (iii) a distance between at least the first separating blade and the first guide element.

According to a particular embodiment of the invention, the positioning means further includes a plate with respect to which at least the first and second separating blades and the first and second guide elements are mounted for movement, the means for selectively setting the distance between the separating blades and the opening roller includes a first lever connected for selectively moving the plate to affect movement of at least the first and second separating blades and the first and second guide elements in a generally radial direction toward and away from the opening roller.

In this embodiment, the means for selectively setting the distance between the guide elements and the opening roller includes a second lever and means for operatively connecting the guide elements and the plate for moving at least the first and second guide elements independently of the first and second separating blades in a generally radial direction toward and away from the opening roller.

Still further, the means for selectively setting the distance between at least the first separating blade and the first guide element includes a third lever and means for operatively connecting at least one of the first separating blade and the first guide element for affecting relative movement between the first separating blade and the first guide element in a direction generally perpendicular to the radial direction.

It is a still further object of the invention to provide a method of cleaning textile fibers, adapted for use in conjunction with an opening roller, the method including the following steps:

- positioning a plurality of separating blades with respect to the opening roller;
- positioning a plurality of guide elements with respect to the opening roller;
- rotating the opening roller for conveying a quantity of textile fibers along an outer periphery of the opening roller; and
- adjusting respective positions of the separating blades and/or the guide elements during rotation of the opening roller.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
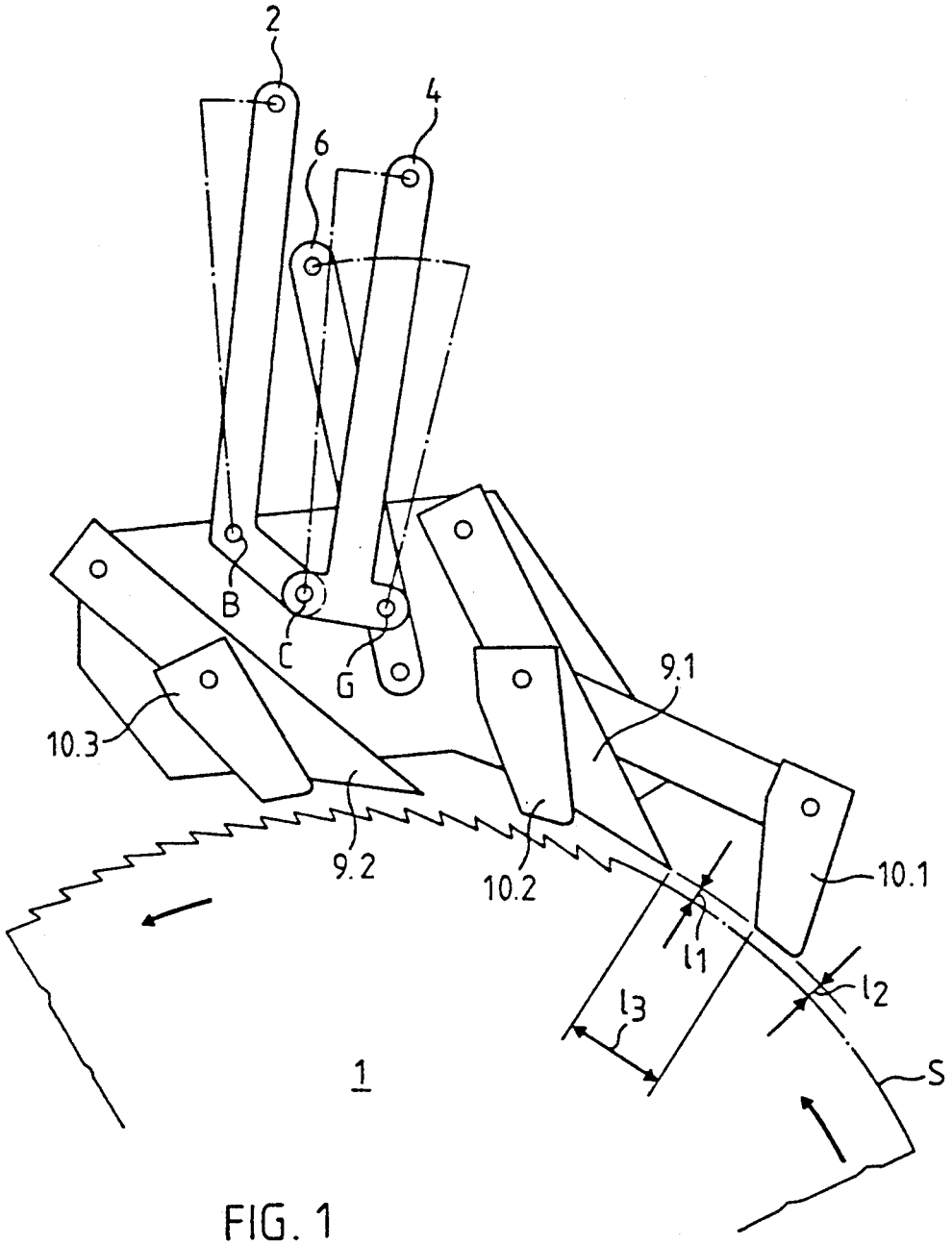
FIG. 1 is a diagram of the device according to the invention, taken in a direction parallel to the axis of rotation of the opening roller.

FIG. 1 shows the device according to the invention with all of its component parts. Shown therein is an exemplary embodiment with two separating blades and three guide elements. Other numbers of separating blades and guide elements could alternatively be provided within the scope of the invention.

On the extreme outside of the periphery of a toothed opening roller 1, the so-called "beater circle" S, the fiber bat is moved to be cleaned by the device according to the invention in the direction of the heavy arrows. In the transport direction, the bat, which is previously subjected to the centrifugal force before the particular cleaning device according to the invention, and through which the contamination particles have concentrated in the outside zone, is first passed under a guide element 10.1. The guide element projects into the transport path of the fiber bat and deflects the bat inwardly, that is, against the centrifugal force, which thereby further intensifies the radial separation into contaminants and fibers.

A separating blade 9.1 follows the guide element in the transport direction of the fibers. The bat is passed beneath separating blade 9.1 and, by means of this arrangement, is separated into a fiber portion and a contamination portion. A second guide element 10.2, a second separating blade 9.2, and a third guide element 10.3 follow the separating blade 9.1.

So that the device according to the invention can be set for fibers from different origins or blends from different origins, the following dimensions can be set:

- the space 1 between the separating blades 9.1 and 9.2 and the beater circle S;
- the space 1 between the guide elements 10.1, 10.2, and 10.3 and the beater circle S; and
- the space 1: between each guide element 10.1 and 10.2 and a respective separating blade 9.1 or 9.2.

In FIG. 1, three levers 2, 4, and 6 are also shown, with the help of which the aforementioned three spaces $1_1$, $1_2$, $1_3$, can be remotely set through a motorized drive. For example, it is contemplated that each of the levers could be operatively connected with a respective fluid-actuated jack which is selectively controllably positionable by means of a controller. Upon a determination that a fiber bat of a particular origin, or blend of origins, is to be cleaned, the appropriate control signal(s) would be sent to the controller(s) for the respective jacks for appropriately positioning any number or all of the levers 2, 4, and 6, based upon the fiber origin, the blend of fiber origins, or other known characteristic of the fiber or the fiber bat. It is also contemplated that the respective levers 2, 4, and 6 could be remotely manually operated to appropriately set the aforementioned spaces $1_1$, $1_2$, $1_3$.

With more specific reference to the motion of the lever unit, when the lever 2 moves about axis B, as shown with dash-dotted lines in FIG. 1, then the entire device moves away from the beater circle, that is, $1_1$ and $1_2$ become greater to the same extent. The respective positions of the lever 2 and the separating blades 9.1 and 9.2 shown in FIG. 1 represent their nearest positions to the beater circle during operation of the cleaning device of the invention.

When the lever 4 is moved about axis C, as shown in FIG. 1 with dash-dotted lines, then the guide elements 10.1, 10.2, and 10.3 move away from the beater circle, while the separating blades 9.1 and 9.2 retain their positions, that is, $1_2$ becomes greater while $1_1$ remains the same. The respective positions of the lever 4 and the guide elements 10.1, 10.2, and 10.3 shown in FIG. 1 represent the nearest positions to the beater circle with relation to the separating blades.

When the lever 6 is moved about axis G, as shown in FIG. 1 with dash-dotted lines, then all of the guide elements 10.1, 10.2, and 10.3 move in the transport direction of the bat, without alteration of their own radial positions or that of the separating blades 9.1 and 9.2 relative to the beater circle S. In other words, each of the guide elements 10.1, 10.2 move against a respective one of the separating blades 9.1, 9.2 and, thereby , distance $1_3$ becomes smaller. In the position of the lever 6, the guide elements 10.1, 10.2, 10.3, and the separating blades 9.1, 9.2, distance $1_3$ has the greatest possible value.

Variations of the embodiment of the invention shown in FIG. 1 are contemplated. For example:

the first element 10.1 can be omitted;

a third separating blade can follow behind the third guide element 10.3, i.e., the separating device can consist of three pairs, each comprising one guide element and one separating blade; and the entire cleaning step can comprise more than three pairs, each comprising one separating blade and one guide element.

Figure 2:
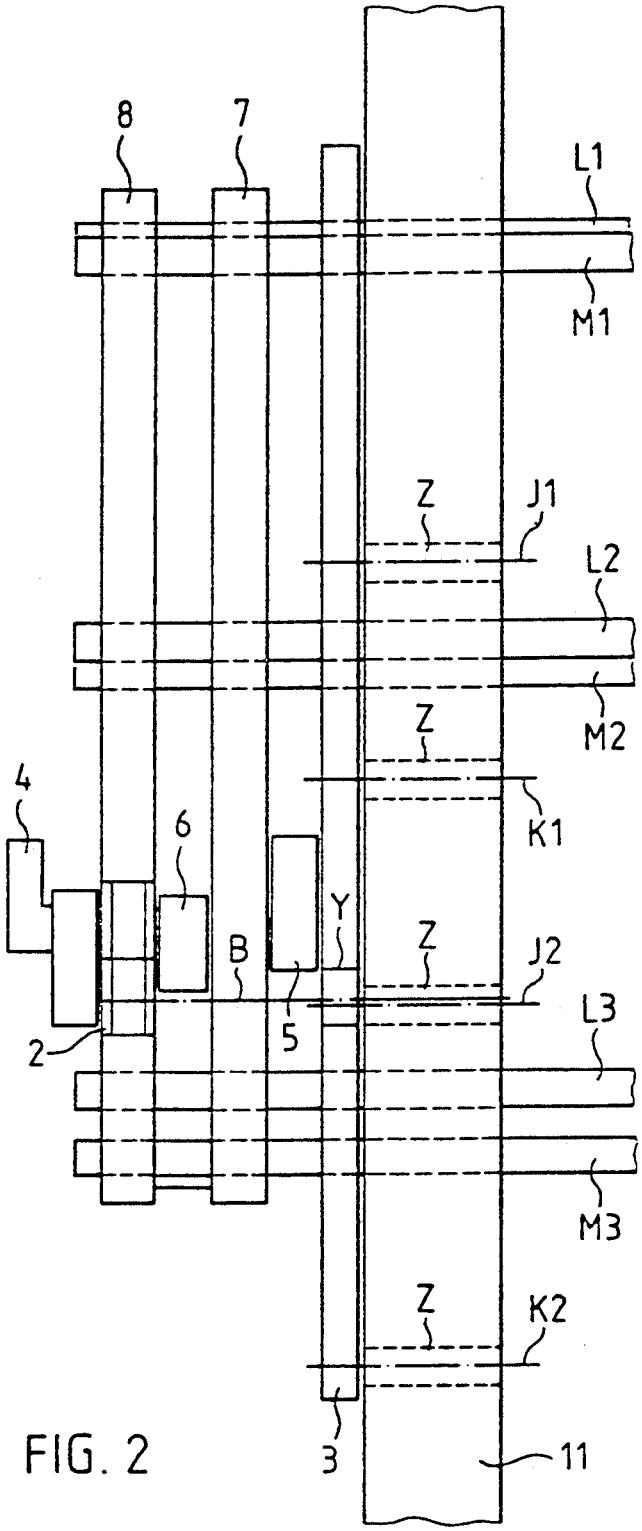
FIG. 2 is a partial view of the device according to the invention, taken in a direction which is perpendicular to the axis of the opening roller.

FIG. 2 shows the device according to the invention from a direction which is perpendicular to the axis of the opening roller 1. From this, it can be seen how the device according to the invention is arranged on the front face of the opening roller.

The face of the opening roller is covered by a housing 11. The lever unit for the operation of the setting of the guide elements and the separating blades, which is explained in greater detail below in conjunction with the remaining figures, is fitted on the side of the housing 11, which faces away from the opening roller. The separating blades 9.1 and 9.2, as well as the guide elements 10.1, 10.2, and 10.3 extend parallel to the axis of the opening roller 1 over their entire length. Neither the separating blades nor the guide elements can be seen in FIG. 2. However, the three pairs of pins L1/M1, L2/M2 and L3/M3 can be seen, which make the connection between the lever unit and the guide elements 10.1, 10.2 and 10.3. Likewise, the two pairs of pins J1/K1 and J2/K2 which connect the lever unit with the separating blades 9.1 and 9.2 are also shown.

The pins L1/M1, L2/M2, L3/M3, and J1/K1, J2/K2, as well as B, C, G, I, H, and E are generally represented in FIG. 2 with dashed lines.

A lever unit on the opposite face of the opening roller is contemplated, which would be formed as a mirror image of the lever unit shown in FIG. 2. In this case, this lever unit could be operatively connected in parallel with the aforementioned motorized drive, although both lever units could be activated by a common controller.

The lever unit consists of three devices, each for the setting of a respective cleaning parameter $1_1$, $1_2$, $1_3$. Thereby, the lever 2 and the plate 3 comprise a first device for the radial setting of the entire device (i.e., controlling $1_1$ and $1_2$ together) on which all the other parts of the device are fitted.

In addition to the lever 4, an intermediate lever 5 and a transverse lever 8 comprise a second device for the setting of the radial position of the guide elements 10.1, 10.2, and 10.3 (i.e., controlling only parameter $1_2$).

In addition to the lever 6, a transverse lever 7 comprises a third device for setting the spacing between the guide elements and the separating blades (i.e., controlling parameter $1_3$).

Figure 3:
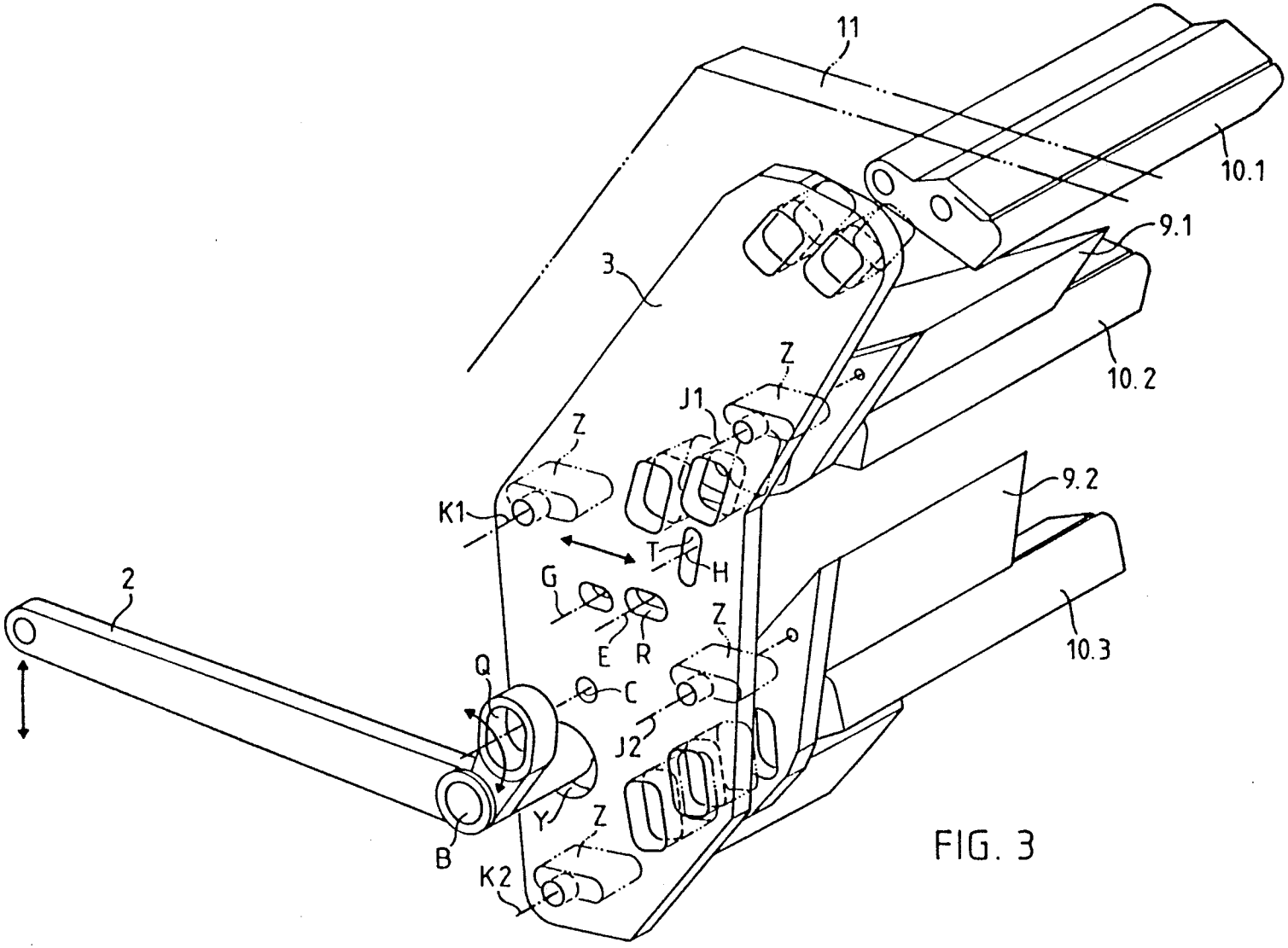
FIG. 3 is a perspective view of the lever unit, comprising a partial device for the adjustment of the space between the entire device and the beater circle.

FIG. 3 illustrates the device for setting the spacing between the entire device and the beater circle S (for setting the parameters $1_1$ and $1_2$). The pair of pins J1/K1 and J2/K2 which rigidly connect the plate 3 with the separating blades 9.1 and 9.2, extend parallel in the housing 11 in guides Z, (see also FIGS. 1 and 2), which run parallel to the radius of the opening roller 1 through the middle of the plate 3. Pin C is pivoted on the plate 3 and connects the plate with the lever 2. When the lever 2 swivels on the pin B on the housing 11, the plate 3 moves in guides Z mentioned above. The slippage resulting from such a movement of the pin C moves this along the appropriate slot in the lever 2. The two separating blades 9.1 and 9.2 and the guide elements 10.1, 10.2, and 10.3 move in the radial direction of the opening roller 1.

Figure 4:
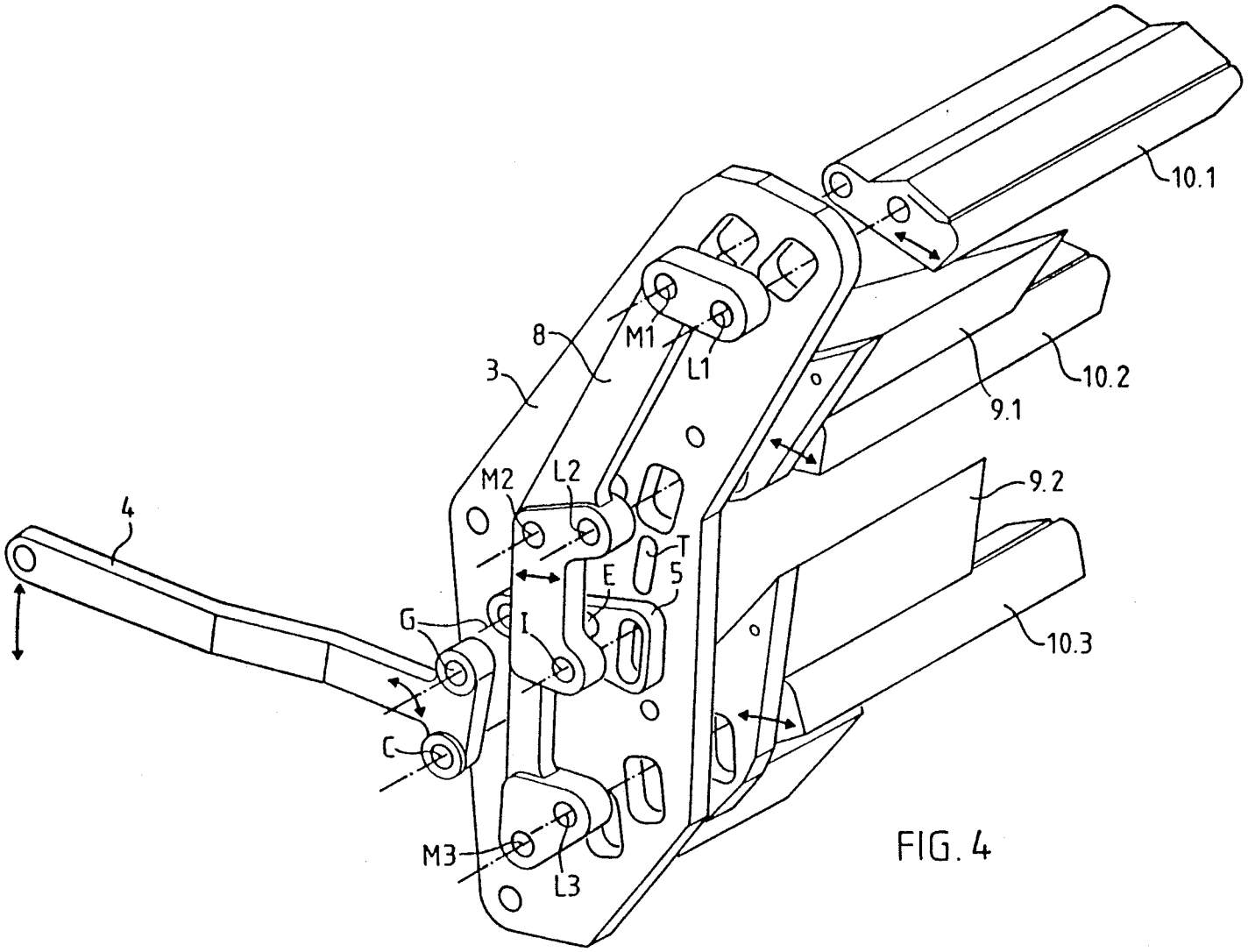
FIG. 4 is a view similar to FIG. 3, illustrating a partial device for the adjustment of the space between the guide element and the beater circle.

FIG. 4 illustrates the device for setting the spacing between the guide elements 10.1, 10.2, and 10.3 and the beater circle S (setting of parameter $1_2$). This spacing is primarily determined through the position of the plate 3 in relation to the beater circle S, but it can, however, still be increased independently of the position of the plate 3. The guide elements 10.1, 10.2, and 10.3 are connected to the transverse lever 8 through the pairs of pins L1/M1, L2/M2, L3/M3. In turn, the transverse lever 8 is connected with the intermediate lever 5 through the pin I. The intermediate lever 5 is pivoted on the lever 4 through the pin G. When the lever 4 is swivelled on the pin C pivoted on the plate 3, the pin G, which has an appropriate guide on the plate 3 (visible in FIG. 3) moves and draws the intermediate lever 5 with it, whereby the pin E, which is rigidly connected with the intermediate lever 5, is guided in a radially running guide (seen in FIG. 3) in the plate 3 and the pin I carries the transverse lever 8 with it. Since the transverse lever 8 is connected to the pairs of pins L1/M1, L2/M2, and L3/M3, these pins move with the guide elements 10.1, 10.2, and 10.3, neglecting the swivel motion of the intermediate lever 5, parallel to the radius of the opening roller 1 running through the middle of the plate 3.

Figure 5:
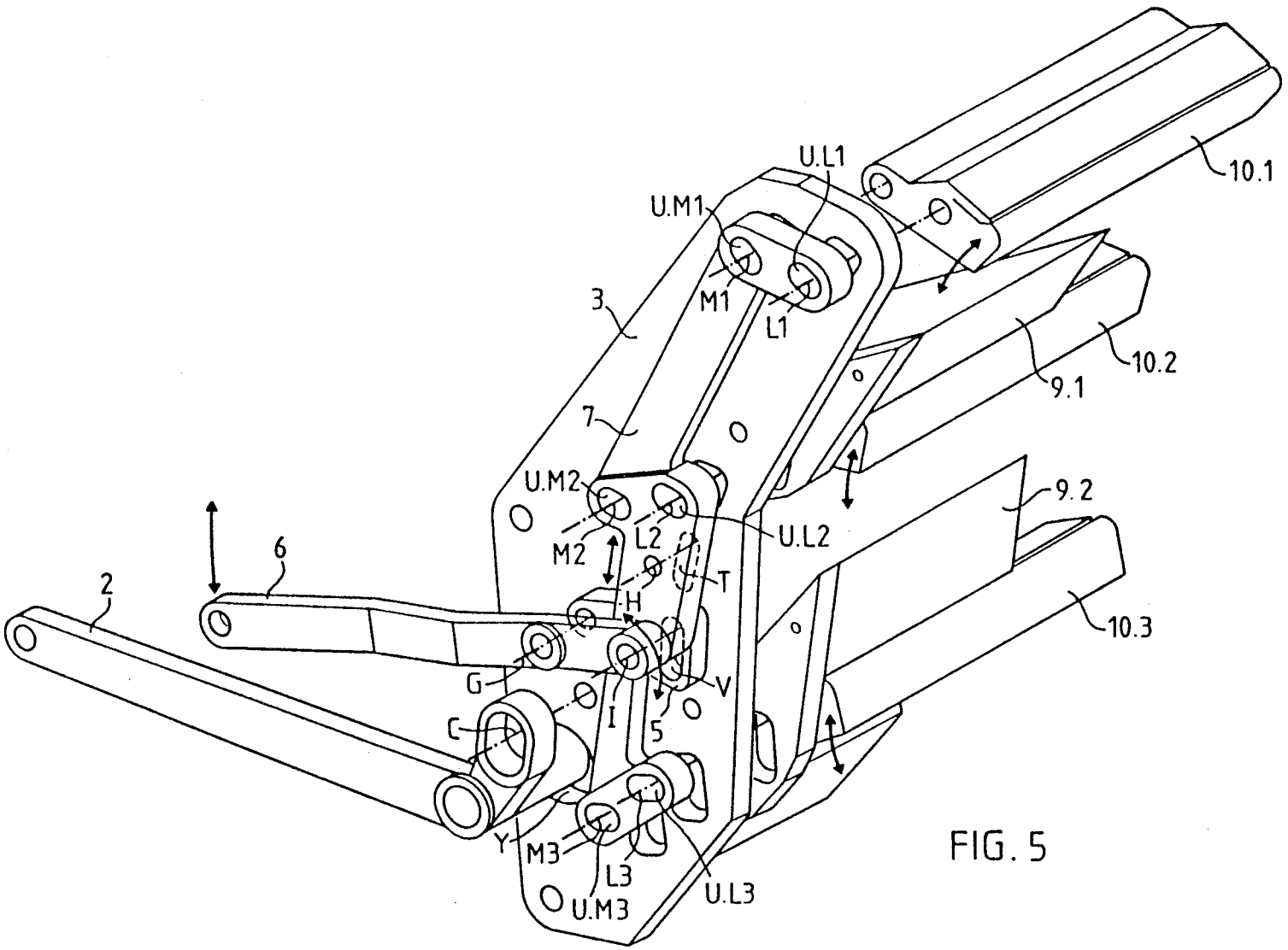
FIG. 5 is a view similar to FIG. 3, illustrating a partial device for the adjustment of the space between the guide element and the separating blade.

FIG. 5 shows the device for the setting of the clearance between each guide element 10.1, 10.2 and a respective separating blade 9.1, 9.2 (setting of parameter $1_3$). The pairs of pins L1/M1, L2/M2 (and also L3/M3) also connect the guide elements 10.1, 10.2 (and also 10.3) with the transverse lever 7. The transverse lever 7 however does not join in the movement actuated by the lever 4 (see FIG. 4), since the pins L1, M1, L2, M2, L3, and M3 slide in corresponding radial slots U.M1, U.L1, U.M2, U.M3,, and U.L3 in the transverse lever 7. The transverse lever 7 is connected through the pin I with the lever 6 which pivots on the pin G. If the lever 6 is swivelled on the pin G, then the pin I moves in its guide V on the intermediate lever 5 in a concentric circle to the beater circle S. Thereby, the pins G and E slide in appropriate slots of the plate 3 (shown in FIG. 3). The transverse lever 7 joins in this movement and is thereby guided through the pin H in the appropriate slot T in the plate 3. The guide elements 10.1, 10.2 (and 10.3) are thereby displaced on a circle concentric to the axis of the opening roller 1, in the direction towards the appropriate separating blades 9.1 and 9.2. Thereby, their radial position relative to the opening roller and relative to the separating blades 9.1, 9.2 is not altered.

No further functions are described with reference to FIGS. 6, 7, and 8, although these figures provide an instruction for the assembly of the lever unit of the invention.

Figure 6:
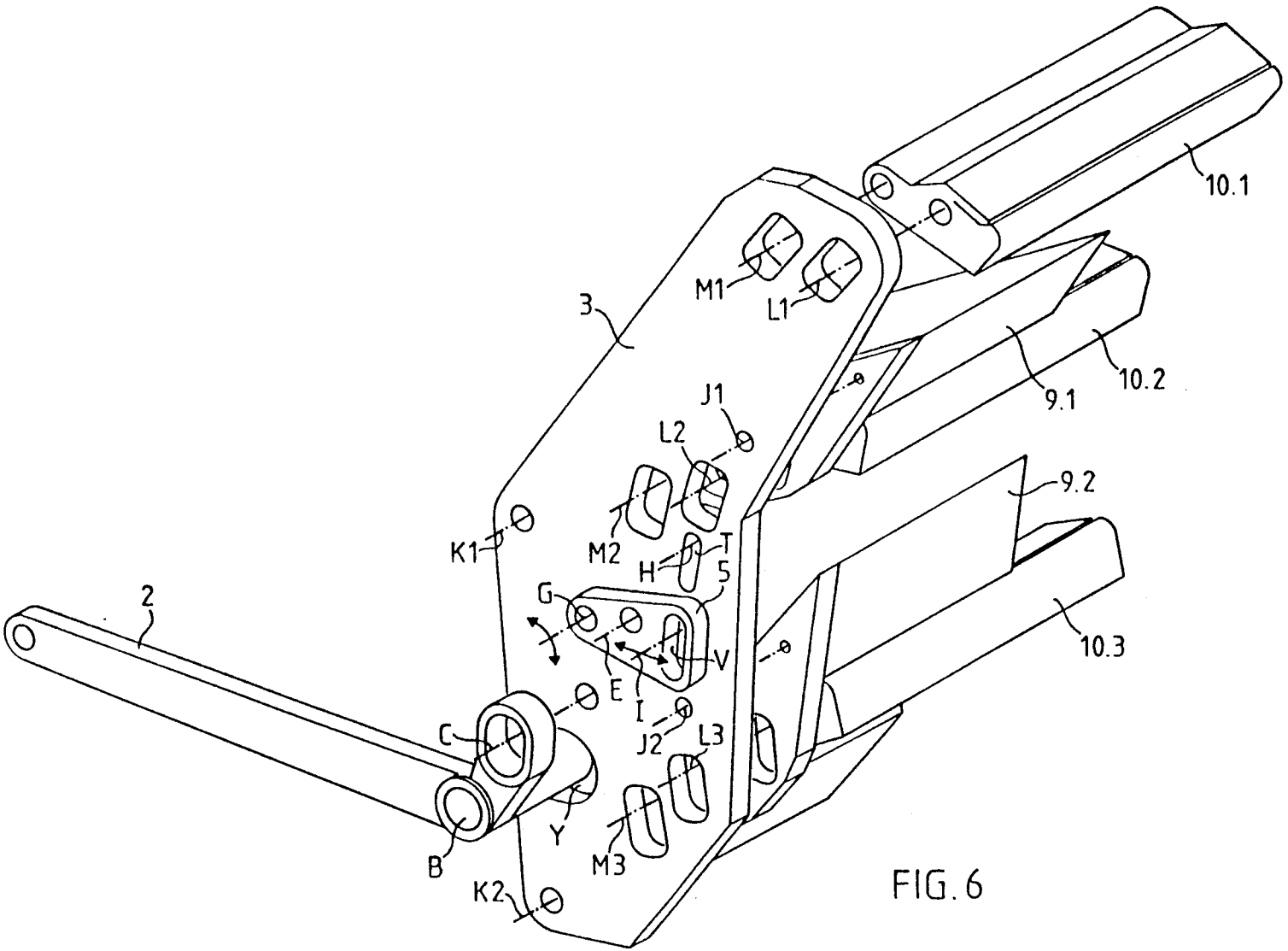
FIGS. 6, 7, and 8 illustrate the step-by-step assembly of the device according to the invention.

FIG. 6 shows the plate 3, the lever 2 with the pin B, and the intermediate lever 5, as well as the pairs of pins L1/M1, L2/M2, and L3/M3, which project through the plate 3 and the housing 11, the points where the pairs of pins J1/K1 and J2/K2 which are fastened on the side of the plate 3 facing away from the lever unit, the pin C, which is pivoted in the plate 3, the pins G, E, and H, which are guided in the appropriate guides in the plate 3, and the pin I, which is pivoted in the intermediate lever 5.

Figure 7:
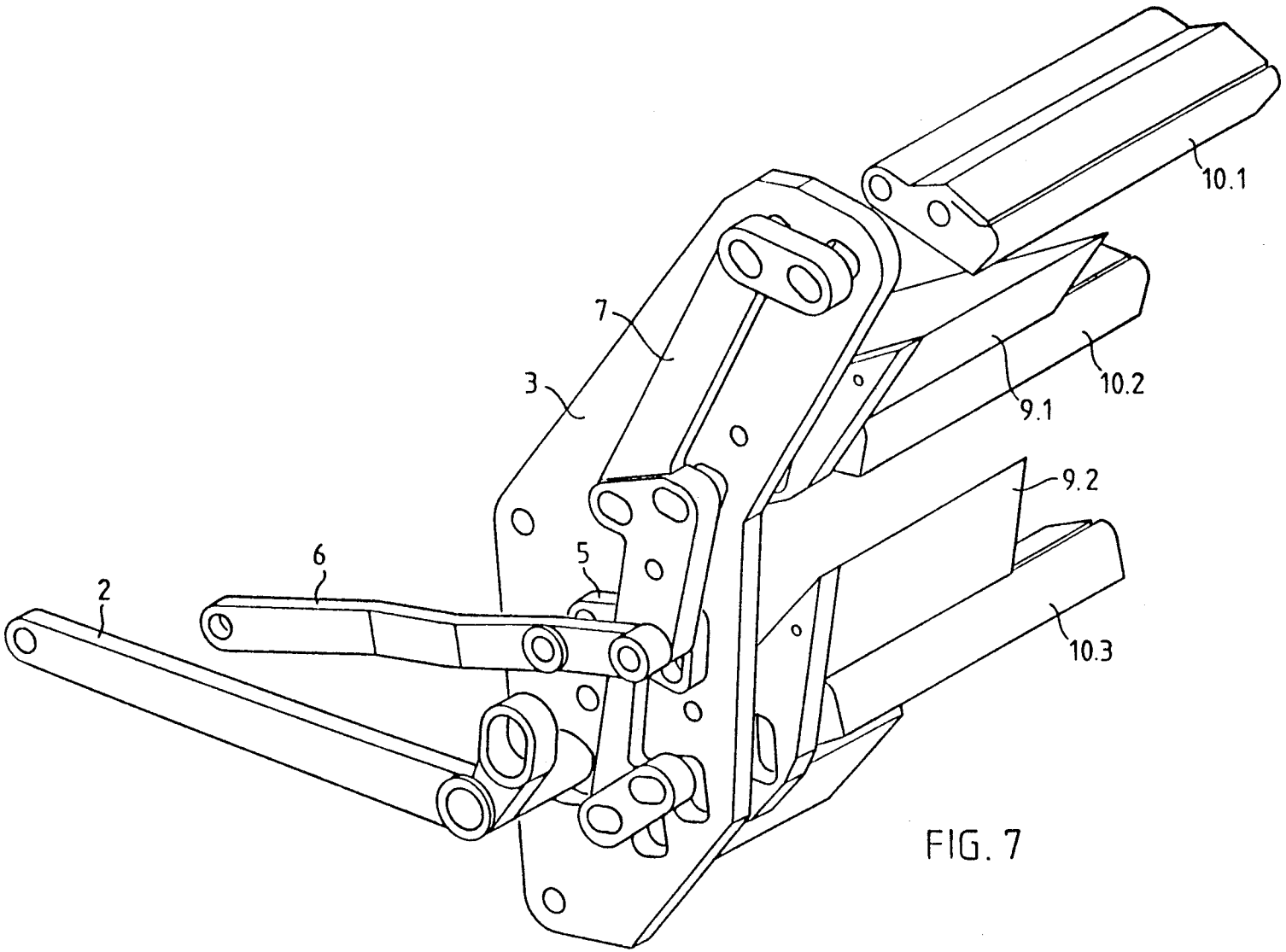

FIG. 7 shows the lever 6 and the transverse lever 7, additionally to the parts of the lever unit which have already been explained in connection with FIG. 6.

Figure 8:
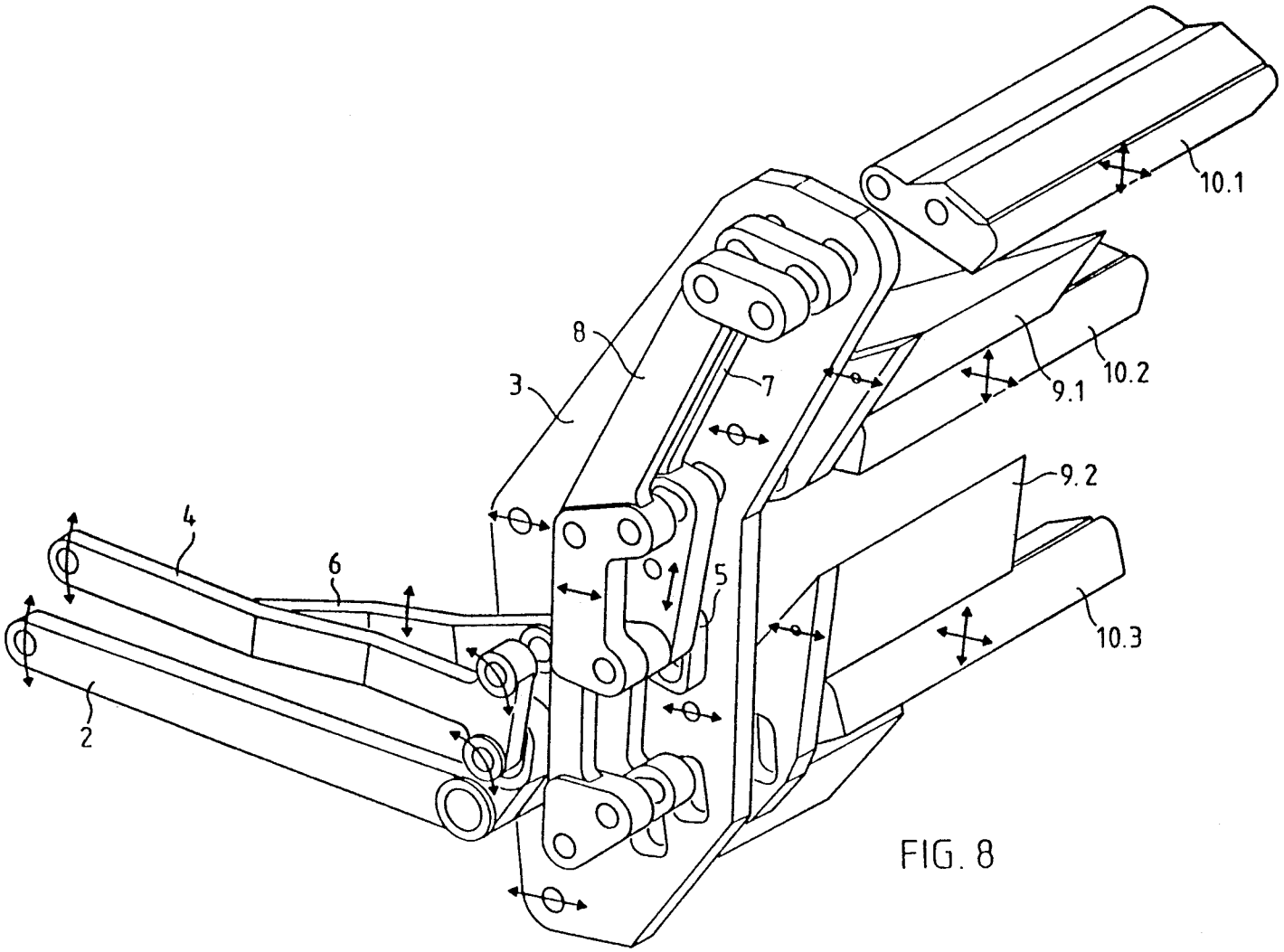

FIG. 8 shows the transverse lever 8 and the lever 4, additionally to the parts of the lever unit which have already been explained in connection with FIGS. 6 and 7.

Finally, although the invention has been described with reference of particular means, materials and embodiments, it is to be understood that the invention is not limited to the particulars disclosed and extends to all equivalents within the scope of the claims.

What is claimed is:

1. A device for use in a cleaning process of textile fibers for use in conjunction with an opening roller, said device comprising:

a plurality of separating blades spaced from said opening roller during said cleaning process;

a plurality of guide elements spaced from said opening roller during said cleaning process; and means for adjustably positioning said separating blades and said guide elements relative to each other in order to selectively alter the distance between each neighboring separating blade and guide element during said cleaning process.

2. The device according to claim 1, wherein said adjustably positioning means comprise structure for conjointly setting the same distance between each neighboring separating blade and guide element of all of said plurality of separating blades and said plurality of guide elements.

3. The device according to claim 1, further comprising means for adjustably positioning at least said guide elements relative to said opening roller in order to selectively alter the distance between the guide elements and the opening roller.

4. The device according to claim 3, further comprising means for adjustably positioning said separating blades and said guide elements relative to said opening roller in order to selectively alter the distance between the separating blades and the guide elements relative to the opening roller.

5. The device according to claim 4, wherein said means for adjustably positioning said separating blades and said guide elements relative to said opening roller comprises a common support frame upon which said plurality of separating blades and said plurality of guide blades are mounted, for selectively adjustably positioning all of said separating blades and said guide elements.

6. The device according to claim 4, wherein each (i) said means for adjustably positioning said separating blades and said guide elements relative to each other in order to selectively alter the distance between each neighboring separating blade and guide element, (ii) said means for adjustably positioning at least said guide elements relative to said opening roller in order to selectively alter the distance between the guide elements and the opening roller, and (iii) said means for adjustably positioning said separating blades and said guide elements relative to said opening roller in order to selectively alter the distance between the separating blades and the guide elements relative to the opening roller, comprises remotely controlled positioning means selectively remotely adjusting respective positions of said separating blades and said guide elements.

7. The device according to claim 6, wherein said remotely controlled positioning means comprises a motorized control assembly.

8. The device according to claim 7, wherein:

said plurality of separating blades comprise at least a first separating blade and a second separating blade; and said plurality of guide elements comprise at least a first, second, and third guide element.

9. A device according to claim 1, wherein said positioning means comprises means for adjusting respective positions of said separating blades and means for adjusting respective positions of said guide elements, said device further comprising means for connecting (i) said means for adjusting respective positions of said separating blades with (ii) said means for adjusting respective positions of said guide elements.

10. A device according to claim 9, wherein said connecting means comprises means for attaching a plurality of said separating blades and said guide elements to a motorized control assembly for selectively remotely adjusting respective positions of said separating blades and said guide elements.

11. A device according to claim 9, wherein said connecting means comprises a lever unit, including a plurality of levers, each of said levers being operatively connected to one or more of said separating blades and one or more of said guide elements for setting a respective adjustment parameter.

12. A device according to claim 11, comprising at least a first separating blade, a first guide element, a second separating blade, and a second guide element.

13. A device according to claim 12, wherein said positioning means comprises means for selectively setting three respective parameters of adjustment: (i) a distance between said separating blades and said opening roller; (ii) a distance between said guide blades and said opening roller; and (iii) a distance between at least said first separating blade and said first guide element.

14. A device according to claim 13, wherein said positioning means further comprises a plate, said first and second separating blades and said first and second guide elements are mounted for movement with respect to said plate, wherein said means for selectively setting said distance between said separating blades and said opening roller comprises a first lever connected for selectively moving said plate to affect movement of at least said first and second separating blades and said first and second guide elements in a generally radial direction toward and away from said opening roller.

15. A device according to claim 14, wherein said means for selectively setting said distance between said guide elements and said opening roller comprises a second lever and means for operatively connecting said guide elements and said plate for moving at least said first and second guide elements independently of said first and second separating blades in a generally radial direction toward and away from said opening roller.

16. A device according to claim 14, wherein said means for selectively setting said distance between at least said first separating blade and said first guide element comprises a lever means and means for operatively connecting at least one of said first separating blade and said first guide element for affecting relative movement between said first separating blade and said first guide element in a direction generally perpendicular to said radial direction.

17. A device according to claim 16, further comprising means for operatively connecting said second separating blade with said second guide element for affecting movement between said second separating blade and said second guide element in said direction generally perpendicular to said radial direction.

18. A method of cleaning textile fibers in conjunction with an opening roller, said method comprising the steps of:

positioning a plurality of separating blades in spaced relationship from said opening roller;

positioning a plurality of guide elements in spaced relationship from said opening roller rotating said opening roller for conveying a quantity of textile fibers along an outer periphery of said opening roller; and adjustably positioning said separating blades and said guide elements relative to each other in order to selectively alter the distance between each neighboring separating blade and guide element during said cleaning process.

19. The method according to claim 18, wherein said step of adjustably positioning said separating blades and said guide elements relative to each other comprises conjointly setting the same distance between each neighboring separating blade and guide element of all of said plurality of separating blades and said plurality of guide elements.

20. The method according to claim 18, further comprising the step of adjustably positioning at least said guide elements relative to said opening roller in order to selectively alter the distance between said guide elements and said opening roller.

21. The method according to claim 20, further comprising the step of the adjustably positioning said separating blades and said guide elements relative to said opening roller in order to selectively alter the distance between said separating blades and said guide elements relative to said opening roller.

22. The method according to claim 1, wherein said step of adjustably positioning said separating blades and said guide elements relative to said opening roller comprises providing a common support frame upon which said plurality of separating blades and said plurality of guide blades are mounted, for selectively adjustably positioning all of said separating blades and said guide elements.

23. The method according to claim 1, comprising the steps of (i) selectively, remotely, adjustably positioning said separating blades and said guide elements relative to each other in order to selectively alter the distance between each neighboring separating blade and guide element, (ii) selectively, remotely, adjustably positioning at least said guide elements relative to said opening roller in order to selectively alter the distance between the guide elements and the opening roller, and (iii) selectively, remotely, adjustably positioning said separating blades and said guide elements relative to said opening roller in order to selectively alter the distance between the separating blades and the guide elements relative to the opening roller.

24. The method according to claim 23, further comprising the step of providing a remotely controlled positioning means for selectively, remotely, positioning respective positions of said separating blades and said guide elements, said remotely controlled positioning means comprising a motorized control assembly.

25. A method according to claim 21, wherein said step of adjustably positioning said separating blades and said guide elements comprises moving said plurality of guide elements and said plurality of separating elements together in a direction toward or away from said periphery of said opening roller.

26. A method according to claim 21, wherein adjustably positioning said separating blades and said guide elements comprises: selectively setting three respective parameters of adjustment: (i) a distance between said separating blades and said opening roller; (ii) a distance between said guide elements and said opening roller; and (iii) a distance between respective ones of said separating blades and said guide elements.

27. The method according to claim 18, comprising the steps of:

providing at least a first separating blade and a second separating blade; and providing at least a first, second, and third guide element.

28. A method according to claim 18, wherein said step of positioning said separating blades comprises moving said plurality of separating blades together in a direction toward or away from said periphery of said opening roller.

29. A method according to claim 18, wherein said step of positioning said guide elements comprises moving said plurality of guide elements together in a direction toward or away from said periphery of said opening roller.

30. A device for use in a cleaning process of textile fibers for use in conjunction with an opening roller, said device comprising:

(a) a plurality of separating blades being spaced from said opening roller during said cleaning process;

(b) a plurality of guide elements being spaced from said opening roller during said cleaning process;

(c) means for remote positioning a plurality of said plurality of separating blades and said plurality of guide elements, wherein said remote positioning means comprises means for adjusting respective positions of said separating blades and means for adjusting respective positions of said guide elements, said device further comprising means for connecting (i) said means for adjusting respective positions of said separating blades with (ii) said means for adjusting respective positions of said guide elements; and (d) said connecting means comprising a common support frame upon which said plurality of separating blades and said plurality of guide elements are mounted, for selectively adjustably positioning all of said separating blades and said guide elements.

31. A device according to claim 30, wherein said separating blades and said guide elements are located in respective positions in relation to said opening roller, wherein said remote positioning means comprises (i) means for adjusting together respective positions of each of said plurality of said separating blades and (ii) means for adjusting together respective positions of each of said plurality of said guide elements.

32. A device according to claim 30, wherein said connecting means comprises means for positioning a plurality of said separating blades and said guide elements to a motorized control assembly for selectively remotely adjusting respective positions of said separating blades and said guide elements.

* * * * *